United States Patent [19]

Giessen et al.

[11] 4,297,135

[45] Oct. 27, 1981

[54] HIGH STRENGTH IRON, NICKEL AND COBALT BASE CRYSTALLINE ALLOYS WITH ULTRAFINE DISPERSION OF BORIDES AND CARBIDES

[75] Inventors: Bill C. Giessen, Cambridge, Mass.; Donald E. Polk, Washington, D.C.; Ranjan Ray, Waltham, Mass.

[73] Assignee: Marko Materials, Inc., North Billerica, Mass.

[21] Appl. No.: 95,383

[22] Filed: Nov. 19, 1979

[51] Int. Cl.[3] ..... C22C 19/05; C22C 38/22

[52] U.S. Cl. ..... 75/123 B; 75/126 P; 75/128 F; 75/129; 75/170; 75/171; 75/255

[58] Field of Search ..... 75/129, 135, 254, 255, 75/123 B, 126P, 128 F, 170, 171, 176, 134 F, 238, 242, 244

[56] References Cited

U.S. PATENT DOCUMENTS

| | | | |
|---|---|---|---|
| 2,757,084 | 7/1956 | Cape et al. | 75/134 |
| 3,149,411 | 9/1964 | Smiley et al. | 29/182.8 |
| 3,723,359 | 3/1973 | Borg et al. | 252/513 |
| 3,736,128 | 5/1973 | Cadenet et al. | 75/126 |
| 3,970,445 | 7/1976 | Gale et al. | 75/0.5 B |
| 3,986,867 | 10/1976 | Masumoto et al. | 75/126 A |
| 4,113,920 | 9/1978 | Helton et al. | 428/565 |
| 4,133,680 | 1/1979 | Babaskin et al. | 75/129 |
| 4,141,160 | 2/1979 | Olson | 37/141 R |
| 4,145,213 | 3/1979 | Oskarsson et al. | 75/238 |
| 4,152,146 | 5/1979 | Freilich et al. | 75/123 B |
| 4,173,685 | 11/1979 | Weatherly | 428/556 |
| 4,181,523 | 1/1980 | Bhansal | 75/171 |
| 4,188,207 | 2/1980 | Kruske | 75/122 |
| 4,192,672 | 3/1980 | Moskowitz et al. | 75/0.5 |

OTHER PUBLICATIONS

Yamaguchi et al., Appl. Phys. Letts. 33, (1978), 468.

*Primary Examiner*—Upendra Roy
*Attorney, Agent, or Firm*—Morse, Altman, Oates & Dacey

[57] ABSTRACT

Alloys, of iron, cobalt, nickel and chromium containing both metalloids and refractory metals are disclosed. The alloys are rapidly solidified at cooling rates of $10^5$-$10^7$ ° C./sec so as to produce an ultrafine grained metastable crystal structure having enhanced compositional homogeneity. The as-quenched metastable alloys are brittle, permitting pulverization, if desired. Heat treatment is used to convert the metastable brittle alloys into ductile alloys with primary grains of ultrafine grain size which contain an ultrafine dispersion of boride as well as carbide and/or silicide particles. The powders or ribbons can be consolidated into bulk parts. The heat treated alloys possess good mechanical properties, in particular high strength and hardness, as well as good corrosion resistance for selected compositions, making them suitable for many engineering applications.

10 Claims, No Drawings

HIGH STRENGTH IRON, NICKEL AND COBALT BASE CRYSTALLINE ALLOYS WITH ULTRAFINE DISPERSION OF BORIDES AND CARBIDES

BACKGROUND OF THE INVENTION

1. Field of the Invention

This invention relates to alloys rich in iron, nickel, cobalt and chromium which form a metastable crystal structure characterized by ultrafine grain size and enhanced compositional uniformity when subjected to rapid solidification processes. Heat treatment of this material causes the precipitation of ultrafine particles (borides, carbides and/or silicides) so as to produce an alloy with desirable mechanical properties.

2. Description of the Prior Art

Rapid solidification processing techniques offer outstanding prospects for the creation of new breeds of cost effective engineering materials with superior properties. (See Proceedings, Int. Conf. on Rapid Solidification Processing, Reston, Virginia, Nov. 1977, published by Claitor's Publishing Division, Baton Rouge, Louisiana, 1978.) Metallic glasses, microcrystalline alloys, highly supersaturated solid solutions and ultrafine grained alloys with highly refined microstructures, in each case often having complete chemical homogeneity, are some of the products that can be made utilizing rapid solidification processing (RSP). [See Rapidly Quenched Metals, 3rd Int. Conf., Vol. 1 & 2, B. Cantor, Ed., The Metal Society, London, 1978. ]

Several techniques are well established in the state of the art to economically fabricate rapidly solidified alloys (at cooling rates of $10^5$-$10^7$° C./sec) as ribbons, filaments, wire, flakes or powders in large quantities. Examples include (a) melt spin chill casting, whereby melt is spread as a thin layer on a conductive metallic substrate moving at high speed (see Proc. Int. Conf. on Rapid Solidification Processing, Reston, Virginia, Nov. 1977), and, (b) forced convective cooling by helium gas of centrifugally atomized molten droplets (see Proc. Int. Conf. on Rapid Solidification Processing, Reston, Virginia, Nov. 1977, Baton Rouge, Louisiana).

The current technological interest in materials produced by rapid solidification processing, especially when followed by consolidation into bulk parts, may be traced in part to the problems associated with the chemical segregation that occurs in complex, highly alloyed materials during the conventional processes of ingot casting and processing. During the slow cooling characteristic of casting processes, solute partitioning, i.e. macro and micro-segregation within the different alloy phases present in these alloys, and the formation of undesirable, massive grain boundary eutectics can occur. Metal powders produced directly from the melt by conventional techniques, by inert gas or water atomization of the melt, are usually cooled at rates three to four orders of magnitude lower than those that can be obtained by rapid solidification processing. Rapid solidification processing removes macro-segregation altogether and significantly reduces the spacing over which micro-segregation occurs, if it occurs at all.

Design of alloys made by conventional slow cooling processes is largely influenced by the corresponding equilibrium phase diagrams, which indicate the existence and coexistence of the phases present in thermodynamic equilibrium. Alloys prepared by such processes are in, or at least near, equilibrium. The advent of rapid quenching from the melt has enabled materials scientists to stray further from the state of equilibrium and has greatly widened the range of new alloys with unique structure and properties available for technological applications. Thus, it is known that the metalloid boron has only very low solid solubility in the transition metals Fe, Ni and Co. Alloys of Fe, Ni and Co containing significant amounts of boron, e.g. in the range of 5-10 at%, prepared by conventional technology have at most limited usefulness because they are extremely brittle. This brittleness is due to a network of a hard and brittle eutectic boride phase present along the boundaries of the primary grains of the alloys.

The presence of these hard borides in these alloys could be advantageous if they could be made to be finely dispersed in the matrix metals in the same manner in which certain precipitates are dispersed in precipitation-hardened or dispersion-hardened commerical alloys based on Al, Cu, Fe, Ni, Co and the like.

SUMMARY OF THE INVENTION

This invention features a class of metal alloy compositions defined by the formula $M_aR_bX_c$, where: M is one or more of the elements iron, nickel, cobalt and chromium: R is one or more of the elements zirconium, tantalum, niobium, molybdenum, tungsten, titanium and vanadium; and X is one or more of the elements boron, silicon and carbon; and where the subscripts represent atomic percent, $85 \leqq a \leqq 95$, $1 \leqq b \leqq 12$, $3 \leqq c \leqq 12$ and boron is present at a level of at least 3 at %. The said alloys are subjected to rapid solidification processing to produce a metastable crystal structure having enhanced compositional uniformity, and to subsequent heat treatment so as to have an ultrafine grain structure, dispersion-hardened with boride, carbide and/or silicide particles, with desirable mechanical properties, in particular high strength. Consolidation of the filaments or powders obtained from the rapid solidification processed material is described.

DETAILED DESCRIPTION OF THE PREFERRED EMBODIMENTS

In accordance with the invention, crystalline alloys rich in iron, nickel, cobalt and/or chromium, which also contain (a) boron and in some cases carbon and silicon, and, (b) refractory metals, are provided. These alloys in molten form are subjected to rapid solidification processing which produces an ultrafine grain crystalline alloy containing a metastable crystal structure, in particular, a solid solution wherein the metalloids and refractory metals are dissolved within the iron, nickel, cobalt and/or chromium matrix, and enhanced compositional uniformity. A subsequent appropriate heat treatment is used to precipitate ultrafine particles of complex metal borides, and in some cases carbides and silicides, and/or intermetallic compounds containing more than one of B, C and/or Si the particles having a characteristic size less than ~0.5 micron, preferably less than 0.2 micron, which are dispersed in the iron, nickel, cobalt and/or chromium base matrix which has a characteristic grain size less than ~10 micron, preferably less than 3 micron. The boride particles are dispersed throughout the interior of the grains and also along the grain boundaries.

The compositions of the alloys of the present invention are given by the formula (A): $M_aR_bX_c$, where: M is one or more of the elements iron, nickel, cobalt and chromium, R is one or more of the elements zirconium, tantalum, niobium, molybdenum, tungsten, titanium and vanadium, and X is one or more of the elements boron, silicon and carbon; and where the subscripts represent atomic percent, $85 \leqq a \leqq 95$, $1 \leqq b \leqq 12$, $3 \leqq c \leqq 12$ and boron is present at a level of at least 3 at %. Since $a+b+c=100$, the total additive level, i.e., the total amount of metalloids plus refractory metals, which is given by $(b+c)$ is within the range of 5–15 at %. Preferably $7 \leqq c \leqq 11$. Alloys rich in iron are of special interest because of their low cost and desirable mechanical properties. The refractory metals molybdenum and tungsten are of special interest as additives because of their marked effect in improving mechanical properties, in particular hardness and tensile strength. Iron based alloys which contain from ~10–40 at % chromium are of special interest because they combine good corrosion resistance with high strength.

It is also noted that small additions of other elements, in particular those which are found in commercial iron- and nickel-rich alloys, e.g., Al, Mn, and Cu, to the compositions described above does not generally produce significantly different alloys in terms of the properties of interest here.

The above stated alloys are melted and then rapidly solidified in the form of ribbon, filament, sheet, powder and the like at solidification rates of the order of $10^{5}$°-$10^{7}$ ° C./sec, as can be achieved by many known rapid solidification processing (RSP) methods such as spreading the molten alloy as a thin layer on a rapidly moving chill substrate (melt spinning), by forced convective cooling of the atomized melt or by any other known rapid liquid quenching method. The most significant effect of rapid solidification in the present invention is that it prevents formation of massive particles of the brittle boride phase in a eutectic configuration along the primary grain boundaries and the accompanying large scale compositional segregation such as will be found in alloys solidified by conventional slow casting processes. Instead, boron is retained substantially or totally in a metastable solid solution phase of the base metals Fe, Ni, Co and/or Cr. The solid solution phase will have either a body centered cubic, a face-centered cubic or a hexagonal close packed structure, depending upon the relative amounts of the iron, nickel, cobalt and chromium (and to a lesser extent the identity and level of the alloying elements) which are present. Upon cooling, some alloys with cooling rates lying at the lower limit of those being used, i.e. at ~$10^{5}$ ° C./sec, and in particular for alloys having high boron contents, a small amount of eutectic borides may be present, although with particle sizes much finer (typically two orders of magnitude smaller) than those obtained in conventionally cooled alloys.

When rapidly solidified, the alloys of the formula (A) are brittle and hence the rapidly solidified ribbons can be readily comminuted into powder by standard methods. The foregoing rapidly solidified alloys, consisting predominantly (more than 50%) of solid solution phase substantially supersaturated with boron, are heat treated between 600° and 1100° C. for specified lengths of time. Heat treatment times may range between 0.1 to 100 hours, usually from 1 to 10 hours. As a result of such heat treatment, precipitation of ultrafine complex metallic borides such as MB, $M_2B$, $M_6B$, $M_{23}B_6$ and the like takes place, where M is one or more of the metals in the alloys. If the alloys also contain carbon and/or silicon, then carbides and silicides will also precipitate out as ultrafine particles with average particle size of less than ~0.5 micron, similar in size to those of the borides, or similarly sized particles containing more than one of B, C and/or Si can be obtained. The heat treatment also causes a slight coarsening of the primary grains, and/or recrystallization of parent grains in the quenched alloys into new strain-free grains and/or relief of residual stresses formed in the alloys during rapid solidification processing. The heat treated multiphase alloys with the foregoing microstructure possess high hardness (at least 500 VHN), high tensile strength (at least 200,000 psi) good ductility and high thermal stability.

The above alloys prepared by rapid solidification into brittle ribbons or powders and subsequently heat treated (as described) are found to have superior mechanical properties which qualify them for many applications where their strength can be utilized to advantage, e.g., in the reinforcing of composites where the heat-treated ribbons could be used directly without requiring consolidation.

Furthermore, rapidly solidified powders of the above alloys prepared by comminution of brittle ribbons or, alternatively, other known methods of producing metal powders at high cooling rates directly from the melt, such as forced convective cooling by helium gas of atomized liquid droplets, can be consolidated into bulk shapes by various powder metallurgical techniques. These techniques include prior or subsequent heat treatment (if the consolidation process does not in effect produce sufficient heat treatment) to produce the above-described microstructure and mechanical properties suitable for numerous engineering applications at room and elevated temperatures requiring materials with good mechanical properties and corrosion and oxidation resistance such as gas turbine engine parts, high temperature bearing materials, cutting tools, hot work dies, wear resistant parts, nuclear reactor control rods and the like. The rapidly solidified powders described can also be used as powders for various magnetic applications. Further, they may be used as feedstock for spraying wear-resistant coatings. Alternatively, the rapidly solidified filaments, as-formed or after partial mechanical fragmentation or chopping, can be consolidated directly without forming an intermediate powder.

When the combined metalloid content (B+C+Si) is greater than ~12 at %, in particular when the B content is high, it becomes difficult to form a solid solution phase. Instead the alloys become amorphous and ductile in the rapidly solidified state. The refractory metals also enhance the ease of glass formation. Thus, when the combined contents of the metalloids B, C and Si and of the refractory metals, i.e., b +c, exceeds ~15 at %, the alloys tend to form a ductile amorphous phase instead of a crystalline solid solution upon rapid solidification.

At boron contents below ~3 at %, the alloys are difficult to form as rapidly solidified ribbons by the method of melt deposition on a rotating chill substrate, i.e., melt spinning. This is due to the inability of alloy melts with low boron contents to form a stable molten pool on the quench surface. Such alloys do not readily spread into a thin layer on a rotating substrate as required for melt spinning. Furthermore, at very low metalloid content the alloys have less desirable mechanical properties in the heat treated condition because of having insufficient amounts of the strengthening intermetallics, i.e., borides, carbides and silicides, that can be formed by these heat treatments.

For alloys of specific compositions, the microstructural characteristics of the heat-treated alloys will change with different heat treatment conditions. The heat treatments process therefore forms a part of the present invention since the mechanical properties, i.e., the tensile strength, ductility and hardness of the heat-treated alloys of the present invention, depend strongly on the microstructure of these alloys. The microstructure of the alloys of formula (A), heat treated according to the previously described schedule, consists of ultrafine borides and in some cases carbides and/or silicides with particle sizes of less than ~0.5 micron and preferably less than 0.2 micron, the matrix grain size is less than ~10 micron, preferably in the range of 1-2 micron.

The rapidly solidified brittle ribbons can be mechanically comminuted into powder, e.g., with particle sizes smaller than 100 mesh (U.S. standard), by standard known equipment such as a ball mill, hammer mill, pulverizer, fluid energy mill, or the like. Either powders, made either from ribbon or directly from the melt, or the filaments can be consolidated into fully dense bulk parts by various known metallurgical processing techniques such as hot isostatic pressing, hot rolling, hot extrusion, hot forging, cold pressing followed by sintering, etc.

EXAMPLES 1-10

A number of iron, nickel, cobalt and/or chromium base alloys containing boron and in some cases carbon and/or silicon in addition to zirconium, titanium, tantalum, niobium, tungsten, molybdenum, vanadium and manganese in accordance with the present invention are fabricated as rapidly solidified ribbons by the melt spinning technique. This involves the impingement of a molten jet of the above alloys onto a rapidly moving (~6000 ft/min) outside surface of a rotating circular substrate such as a precipitation-hardened beryllium copper alloy wheel. The rapidly cast ribbons are found by X-ray diffraction analysis to consist of a predominantly metastable supersaturated solid solution phase having either a body-centered cubic or a face-centered cubic structure depending on the base metal or metals. The as-quenched ribbons have hardness values ranging between 700 and 1100 kg/mm$^2$. The ribbons are tested for bend ductility as follows: A ribbon is bent to form a loop and the diameter of the loop is gradually reduced between the anvils of a micrometer until the ribbon fractures. The breaking diameter is taken as a measure of bend ductility of the ribbon. The as-quenched ribbons as stated above are found to be rather brittle, i.e., they fracture when bent to a radius of curvature less than 100 times thickness. The ribbons are heat-treated at 950° C. for 1 hour and cooled to room temperature. The heat-treated ribbons are found to become more ductile, i.e., they now do not break until bent to a radius of curvature less than 25 times thickness. The hardness values of the heat treated ribbons range between 650 and 1100 kg/mm$^2$. Compositions, hardness values and bend ductility values of these alloys are given in Table 1.

EXAMPLES 11-21

A number of iron, nickel and cobalt base alloys containing boron as the only metalloid, in accordance with the present invention, were fabricated as rapidly solidified ribbons by the melt spinning technique which involves the impingement of a molten jet of these alloys onto a rapidly moving (~6000 ft/min) outside surface of a rotating circular chill substrate, such as a precipitation-hardened beryllium copper alloy wheel. The rapidly cast ribbons were found by X-ray diffraction analysis to consist predominantly of a metastable supersaturated solid solution phase having either a body-centered cubic or a face-centered cubic structure, depending on the base metal or metals chosen. In addition to the solid solution phase, some of the alloys were found to contain a small amount of fine boride phase particles. The as-quenched ribbons have hardness values ranging between 750 and 1000 kg/mm$^2$ and poor bend ductility. Upon heat treatment at 950° C. for 1 hour the ribbons became more ductile as shown by the bend test described; this was accomplished by some decrease in hardness. The above heat treatment resulted in the precipitation of ultrafine particles (less than 0.3 micron in diameter) of borides in a fine grained matrix as seen in an optical micrograph. Compositions, hardness values and bend ductility values of these alloys are given in Table 2.

EXAMPLES 22-27

A number of iron base alloys within the scope of the present invention were fabricated as ribbons by the rapid solidification processing (RSP) method described above (Stage 1). The ribbons were found to be very hard and brittle (see Table 3) and consisted predominantly of a single solid solution phase with a body-centered cubic crystal structure. The ribbons were heat treated at 750° C. for two hours (Stage 2). The heat treatment resulted in precipitation of ultrafine metallic carbides, MC, $M_2C$, $M_6C$, $M_{23}C_7$, and the like, and metallic borides MB, $M_2B$, $M_6B$, and the like, or mixed borides-carbides [where M is one or more of the metals constituting the alloys] in a fine-grained, iron-rich matrix. These carbides and borides have average particle sizes of less than 0.3 microns. The heat-treated alloys showed a considerable increase in ductility and decrease in hardness (see Table 3).

After stage 2, the above-mentioned ribbons were annealed by a heat treatment (similar to that applied to high carbon steels as a spheroidizing treatment) at 925° C. for 1 hour, followed by slow cooling at 20° C./hour to 480° C., followed by air cooling to room temperature (stage 3). The above heat treatment caused conversion of part of the ultrafine carbides into spheroidized coarser carbides while ultrafine borides remained unchanged. The ribbons were found to be completely ductile to 180° bending; this ductility increase was accompanied by considerably softening (see Table 3).

Following stage 3, the ribbons were hardened by methods similar to those applied to harden commercial high carbon steels (stage 4). The ribbons were annealed at 1080° C. for ½ hour (austenization treatment) whereby coarse carbides and part of the remaining ultrafine carbides were dissolved in an iron-rich, face-centered cubic (fcc) phase (austenite). Following the 1080° C., ½ hour heat treatment, the ribbons were rapidly quenched in air to a temperature below the austenite-to-martensite transformation temperature [martinsite being a body centered tetragonal phase] whereby the hardness of the ribbons again increased considerably due to formation of martensite (see Table 3). The microstructure at this stage consists of ultrafine metallic borides and carbides dispersed in a hard martensitic matrix.

After hardening, the ribbons were heat treated at 400° C. for 2 hours (stage 5) whereby martensite was transformed into ferrite (bcc phase) and fine carbides. This heat treatment, commonly known as tempering, increased the bend ductility of the ribbons with a slight loss in hardness (see Table 2).

The sequence of heat treatments described above has considerable practical significance in the processing of the alloys of the invention into finished products as shown in the following. After stage 1, the RSP-processed alloys of the present invention, as exemplified in Table 2, are in the brittle ribbon form; at that point they can be pulverised readily into powders by standard comminuting methods such as hammer milling with the resulting particle sizes lying preferably under 100 mesh (U.S. standard).

After stage 2, ribbons, fragmented ribbons, and comminuted powders have sufficient ductility to allow them to be hot consolidated at temperatures between 950° C. and 1100° C. by hot isostatic pressing, hot extrusion, hot rolling, hot forging, and the like, into fully dense structural parts or bodies of any desired size and shape.

The consolidated parts or bodies can then be annealed according to stage 3, whereby they soften considerably resulting in a hardness preferably around 300 kg/mm$^2$. Hence, they are in a form suitable for machining into any finished components, tools or parts. Last, the finish-machined components can be hardened (by the heat treatment of stage 4) and tempered (stage 5) to have the desired final high hardness, tensile strength and ductility/toughness.

Another procedure of fabricating bulk parts/components of final geometry from the RSP-processed powders is as follows:

The RSP processed (i.e. ribbon quenched and comminuted) powders are given heat treatments as in stage 2 and stage 3 and are then cold pressed into green compacts of any suitable final geometry. The green compacts are sintered at temperatures between 950° C. and 1100° C. to full or near full density, followed if necessary, by a hot densification treatment, such as hot isostatic pressing or hot forging. Following final consolidation, the parts can be heat treated [i.e. hardened (stage 4) and tempered (stage 5)] to the mechanical properties desired for practical applications.

EXAMPLES 28–37

A number of alloys based on Fe, Ni, or Co and containing B in accordance with the present invention are prepared as rapidly solidified ribbons by the melt spinning process. The ribbons are brittle as determined by the bend ductility test and have low tensile strength (see Table 4) . The ribbons consist predominantly of a solid solution phase. The ribbons are heat-treated at 950° C. for ½ hour and are found to have considerably improved tensile strength (see Table 4).

The improved mechanical properties are due to the microstructure of the alloys which is a result of the quenching followed by heat treatment and consists of ultrafine particles (of less than 0.3 micron particle size) of borides and carbides uniformly dispersed inside the grains as well as along the grain boundaries.

EXAMPLE 38

An alloy having the composition $Fe_{64}Cr_{15}Ni_{10}Mo_3B_8$ within the scope of the present invention was fabricated in the form of rapidly solidified, brittle ribbons in a 250 gram quantity by the melt spinning method described using a chill substrate made of a beryllium copper alloy. The brittle ribbons were subsequently comminuted into powders by a commercial Bantam Mikro Pulverizer (hammer mill). The powders were screened to a size smaller than 100 mesh sieve (U.S. standard). The fractured particles which were found to have smooth faces and straight edges, as seen in an optical micrograph, exhibited excellent flowability as seen on testing their flow through a small orifice having ~0.030" diameter. Such powders may be suitable for application as spray powders for the manufacturing of hard coatings on machine parts by plasma spraying or similar processes.

EXAMPLE 39

This example illustrates a method for the continuous production of rapidly solidified powders of the alloys. The selected alloys within the scope of the present invention are melted in large quantities of several tons in an electric arc or induction melting furnace from scrap and/or virgin alloy material and may be refined, if necessary, by employing suitable slag making procedures. When the melt has reached the final composition and has been superheated to a temperature of 150°–200° C. above the melting (liquidus) temperature, it is transferred into one or more ladles lined with appropriate refractory material. The melt is then transferred from these ladles to a battery of tundishes, each having multiple orifices at the bottom, generating thereby a number of jets of molten metal which are allowed to impinge on water cooled, rotating metallic substrates, travelling metallic belts, or other suitable configurated rapid quenching substrates. The rapidly quenched metal ribbons are then fed directly from the chill substrate into a pulverizer of required size where they are gound into powder.

TABLE 1

Hardness and bend ductility of iron, nickel and cobalt base crystalline alloys within the scope of the present invention in the rapidly solidified (as cast) and heat treated condition.

| | | Condition; As cast | | Condition: As cast ribbons heat treated at 950° C., 1 hour | |
|---|---|---|---|---|---|
| Example | Composition (atom percent) | Hardness (Kg/mm$^2$) | Bend Ductility as measured by breaking diameter in inch | Hardness (Kg/mm$^2$) | Bend Ductility as measured by breaking diameter in inch |
| 1 | $Fe_{40}Ni_{30}Cr_{15}Zr_7B_8$ | 925 | 0.110 | 798 | 0.018 |
| 2 | $Co_{50}Ni_{10}Fe_{15}Cr_{11}Ti_4B_{10}$ | 936 | 0.123 | 812 | 0.020 |
| 3 | $Fe_{55}Cr_{30}Mo_2Zr_3B_{10}$ | 1042 | 0.126 | 856 | 0.022 |
| 4 | $Ni_{80}Fe_5V_2Mn_1Ta_3B_9$ | 885 | 0.108 | 807 | 0.023 |
| 5 | $Ni_{70}Cr_{15}Zr_6W_2B_6Si_1$ | 896 | 0.136 | 813 | 0.019 |
| 6 | $Fe_{73}Ni_{12}Ta_4Nb_2B_6C_3$ | 967 | 0.137 | 1056 | 0.030 |
| 7 | $Fe_{84}Zr_{10}B_4Si_2$ | 910 | 0.130 | 845 | .020 |
| 8 | $Fe_{65}Cr_{20}Mo_5B_7C_3$ | 1022 | 0.105 | 1044 | .032 |
| 9 | $Ni_{55}Co_{20}Fe_{10}Ti_{10}B_5$ | 798 | 0.129 | 780 | .016 |

TABLE 1-continued

Hardness and bend ductility of iron, nickel and cobalt base crystalline alloys within the scope of the present invention in the rapidly solidified (as cast) and heat treated condition.

| | | Condition; As cast | | Condition: As cast ribbons heat treated at 950° C., 1 hour | |
|---|---|---|---|---|---|
| Example | Composition (atom percent) | Hardness ($Kg/mm^2$) | Bend Ductility as measured by breaking diameter in inch | Hardness ($Kg/mm^2$) | Bend Ductility as measured by breaking diameter in inch |
| 10 | $Co_{89}Zr_3B_8$ | 850 | 0.131 | 778 | .018 |

TABLE 2

Hardness and bend ductility of iron, nickel and cobalt base crystalline alloys within the scope of the present invention in the rapidly solidified (as cast) and heat treated conditions.

| | | Condition: As cast | | Condition: As Cast ribbons heat treated at 950° C., 1 hour | |
|---|---|---|---|---|---|
| Example | Composition (atom percent) | Hardness ($Kg/mm^2$) | Bend Ductility Breaking diameter (inch) | Hardness ($Kg/mm^2$) | Bend Ductility Breaking diameter (inch) |
| 11 | $Fe_{71.5}Cr_5Ni_{12}W_{1.5}B_{10}$ | 950 | 0.126 | 720 | .014 |
| 12 | $Fe_{78}Cr_4Ni_4Mo_2W_2B_{10}$ | 1010 | 0.120 | 730 | .015 |
| 13 | $Ni_{40}Co_{30}Fe_{15}Cr_5Mo_1B_9$ | 885 | 0.136 | 614 | .005 |
| 14 | $Fe_{82}Cr_3Mo_5B_{10}$ | 1102 | 0.130 | 795 | .014 |
| 15 | $Fe_{74}Cr_{10}Ni_2Mo_2W_2B_{10}$ | 1046 | 0.129 | 737 | .014 |
| 16 | $Ni_{75}Fe_5Cr_5Mo_5B_{10}$ | 1036 | 0.135 | 725 | .006 |
| 17 | $Fe_{60}Cr_{30}Mo_2B_8$ | 975 | 0.130 | 665 | .015 |
| 18 | $Fe_{50}Cr_{40}Mo_1B_9$ | 1067 | 0.108 | 728 | .010 |
| 19 | $Ni_{60}Cr_{31}W_2B_7$ | 1022 | 0.125 | 710 | .010 |
| 20 | $Fe_{64}Cr_{12}Ni_9Mo_9B_6$ | 875 | 0.136 | 605 | .013 |
| 21 | $Fe_{63}Cr_{12}Ni_{10}Mo_9B_6$ | 1087 | 0.120 | 756 | .014 |

TABLE 3

Hardness and bend ductility of Fe-rich alloys of the present invention in the RSP-processed condition and in various heat treated conditions.

| | | Stage 1: RSP processed ribbons | | Stage 2: Ribbons from stage 1 were heat treated at 750° C. for 2 hours | | Stage 3: Ribbons from Stage 2 were heat treated at 950° C. for 1 hour followed by cooling at 20° C./hour to 480° C. followed by air cooling to room temperature | | Stage 4: Ribbons from stage 3 were heat treated at 1080° C. for ½ hr. followed by air cooling to room temperature | | Stage 5: Ribbons from stage 4 were heat treated at 400° C. for 2 hrs. followed by air cooling to room temperature | |
|---|---|---|---|---|---|---|---|---|---|---|---|
| Example | Composition [atom percent] | Hardness ($Kg/mm^2$) | Bend Ductility; Breaking Dia (inch) | Hardness ($Kg/mm^2$) | Bend Ductility; Breaking Dia (inch) | Hardness ($Kg/mm^2$) | Bend Ductility; Breaking Dia (inch) | Hardness ($Kg/mm^2$) | Breaking Dia (inch) | Hardness ($Kg/mm^2$) | Breaking Dia (inch) |
| 22 | $Fe_{70}Cr_{15}Mo_5W_3B_4C_3$ | 1088 | 0.136 | 610 | .025 | 346 | .004 | 1028 | .040 | 978 | .030 |
| 23 | $Fe_{75}Cr_{10}Mo_6W_2B_4C_3$ | 1126 | 0.125 | 590 | .030 | 333 | .003 | 1005 | .055 | 976 | .037 |
| 24 | $Fe_{65}Cr_{20}Mo_7B_5C_3$ | 1055 | 0.115 | 550 | .012 | 355 | .003 | 1036 | .056 | 990 | .035 |
| 25 | $Fe_{70}Cr_{15}Mo_1W_7B_4C_3$ | 1080 | 0.128 | 588 | .026 | 302 | .003 | 1022 | .040 | 960 | .041 |
| 26 | $Fe_{79.8}Cr_{4.4}V_{1.2}W_6C_{3.8}B_{4.5}$ | 1126 | .095 | 453 | .005 | 327 | .003 | 1088 | .055 | 973 | .033 |
| 27 | $Fe_{78.5}V_{1.5}Cr_9Mo_3C_{2.5}B_{5.5}$ | 1046 | 0.110 | 518 | .028 | 295 | .003 | 1046 | .043 | 965 | .032 |

TABLE 4

Ultimate tensile strength and bend ductility of alloys within the scope of the present invention in the rapidly solidified (as cast) state and in the heat treated conditions.

| | | Condition: as cast | | Condition: as cast ribbon heat treated at 950° C. for ½ hr. | |
|---|---|---|---|---|---|
| Example | Composition (atom percent) | Ultimate tensile strength (ksi) | Bend ductility as measured by breaking diameter, inch | Ultimate tensile strength (ksi) | Bend ductility as measured by breaking diameter, inch |
| 28 | $Fe_{52}Ni_{20}Co_{16}Zr_5B_7$ | 92 | 0.125 | 320 | 0.023 |
| 29 | $Ni_{57}Fe_{20}Cr_{10}Mn_2Mo_3B_8$ | 77 | 0.110 | 310 | 0.028 |
| 30 | $Fe_{70}Ni_{15}Mo_9B_6$ | 86 | 0.112 | 295 | 0.020 |
| 31 | $Fe_{45}Cr_{40}Mo_2Ti_5B_5Si_3$ | 93 | 0.128 | 285 | 0.032 |
| 32 | $Fe_{45}Ni_{20}Cr_{10}Co_{10}Zr_{12}B_3$ | 75 | 0.113 | 270 | 0.030 |
| 33 | $Co_{58}Cr_{30}Ti_4B_4C_4$ | 69 | 0.136 | 288 | 0.026 |
| 34 | $Ni_{55}Co_{30}Ta_5Nb_4B_6$ | 65 | 0.133 | 336 | 0.026 |
| 35 | $Fe_{83}V_3Cr_3W_2B_3C_6$ | 74 | 0.125 | 325 | 0.022 |

TABLE 4-continued

Ultimate tensile strength and bend ductility of alloys within the scope of the present invention in the rapidly solidified (as cast) state and in the heat treated conditions.

| Example | Composition (atom percent) | Condition: as cast | | Condition: as cast ribbon heat treated at 950° C. for ½ hr. | |
|---|---|---|---|---|---|
| | | Ultimate tensile strength (ksi) | Bend ductility as measured by breaking diameter, inch | Ultimate tensile strength (ksi) | Bend ductility as measured by breaking diameter, inch |
| 36 | $Fe_{60}Cr_{20}Ni_8W_6B_6$ | 88 | 0.120 | 340 | 0.025 |
| 37 | $Ni_{65}Cr_{20}Zr_6B_6Si_3$ | 93 | 0.105 | 308 | 0.026 |

We claim:

1. A crystalline metal alloy of the formula $M_aR_bX_c$ where M is at least one element selected from the group consisting of iron, nickel, cobalt and chromium and mixtures thereof, R is at least one element selected from the group consisting of zirconium, tantalum, niobium, molybdenum, tungsten, titanium and vanadium and mixtures thereof and X is at least one element selected from the group consisting of boron, silicon and carbon and mixtures thereof, wherein a, b and c are atomic percentages ranging from 85 to 95, 1 to 12 and 3 to 12, respectively, and boron is present at the level of at least 3 at %, said alloy having been prepared from the melt thereof by a rapid solidification process characterized by cooling rates in the range of about $10^5$°to $10^7$ ° C./sec, said alloy subsequently subjected to the application of heat thereto and characterized by a fine grained microstructure with primary grains having an average grain size of less than about 10 microns with a substantially uniform dispersion of ultra fine particles of borides in the fine primary metallic grains, said ultra fine particles having a characteristic particle size of less than 0.5 micron and being dispersed throughout the inside of the primary grains and along the grain boundaries.

2. A crystalline metal alloy of the formula $M_aR_bX_c$ where M is at least one element selected from the group consisting of iron, nickel, cobalt and chromium and mixtures thereof, R is at least on element selected from the group consisting of zirconium, tantalum, niobium, molybdenum, tungsten, titanium and vanadium and mixtures thereof and X is at least one element selected from the group consisting of boron, silicon and carbon and mixtures thereof, wherein a, b and c are atomic percentages ranging from 85 to 95, 1 to 12 and 3 to 12, respectively, boron is present at the level of at least 3 at %, and chromium is present in said alloy in the range of 10 to 40 at %, said alloy having been prepared from the melt thereof by a rapid solidification process characterized by cooling rates in the range of about $10^5$°to $10^7$ ° C./sec, said alloy subsequently subjected to the application of heat thereto and characterized by a fine grained microstructure with primary grains having an average grain size of less than about 10 microns with substantially uniform dispersion of ultra fine particles of at least one of a group consisting of borides, carbides and silicides and mixtures thereof with at least said borides having an average particle size of less than 0.5 micron and being dispersed throughout the inside of the primary grains and along the grain boundaries.

3. A crystalline metal alloy according to claim 1 wherein said ultra fine particles include at least one of a group consisting of borides, carbides, and silicides.

4. A crystalline metal alloy according to claim 3 wherein said alloy is in powder form.

5. A crystalline metal alloy according to claim 3 wherein said alloy is in ribbon form.

6. A crystalline metal alloy according to claim 3 wherein said alloy is in an alloy body having a thickness of at least 0.2 millimeter measured in the shortest dimensions.

7. A crystalline metal alloy according to claim 3 wherein said primary grains have an average large dimension of less than 3 microns and wherein said ultrafine particles have an average large dimension of less than 0.2 micron.

8. A crystalline metal alloy according to claim 2 wherein said alloy is in powder form.

9. A crystalline metal alloy according to claim 2 wherein said alloy is in ribbon form.

10. A crystalline metal alloy according to claim 2 wherein said alloy is in an alloy body having a thickness of at least 0.2 millimeter measured in the shortest dimension.

* * * * *